US009501009B2

(12) United States Patent
Koda et al.

(10) Patent No.: US 9,501,009 B2
(45) Date of Patent: Nov. 22, 2016

(54) FIXING DEVICE AND IMAGE FORMING APPARATUS

(71) Applicant: KYOCERA Document Solutions Inc., Osaka (JP)

(72) Inventors: Shoji Koda, Osaka (JP); Kenichi Kasama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/783,327

(22) PCT Filed: Feb. 16, 2015

(86) PCT No.: PCT/JP2015/054098

§ 371 (c)(1),
(2) Date: Oct. 8, 2015

(87) PCT Pub. No.: WO2015/162977

PCT Pub. Date: Oct. 29, 2015

(65) Prior Publication Data

US 2016/0132003 A1 May 12, 2016

(30) Foreign Application Priority Data

Apr. 24, 2014 (JP) ..... 2014-089857

(51) Int. Cl.
*G03G 15/20* (2006.01)

(52) U.S. Cl.
CPC ..... *G03G 15/2053* (2013.01); *G03G 15/2017* (2013.01); *G03G 2215/2035* (2013.01)

(58) Field of Classification Search
CPC ..... G03G 15/2053; G03G 15/0898; G03G 15/2017; G03G 2215/2035
USPC ..... 399/329, 262, 122, 328
See application file for complete search history.

(56) References Cited

U.S. PATENT DOCUMENTS 5,923,931 A * 7/1999 Kishimoto ..... G03G 15/0822 399/102
6,014,539 A 1/2000 Sano et al.
(Continued)

FOREIGN PATENT DOCUMENTS

JP H10-048977 A 2/1998
JP 2002-231419 A 8/2002
(Continued)

OTHER PUBLICATIONS

International Search Report issued in PCT/JP2015/054098, mailed Apr. 14, 2015.
Written Opinion issued in PCT/JP2015/054098, mailed Apr. 14, 2015.

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A fixing device according to the present invention includes a fixing belt (21), a cap member (28) attached to an end part (21*a*) of the fixing belt (21) and an elastic member (29) arranged between the fixing belt (21) and the cap member (28). The cap member (28) includes a main body part (55) covering an outside of the end part (21*a*) of the fixing belt (21) and a flange part (56) extending from the main body part (55) to an inside and covering an outer diameter side of the end part (21*a*) of the fixing belt (21). A step (s) is formed in an inner circumference face of the flange part (56). An outer circumference face of the elastic member (29) comes into contact with an inside part from the step (s) in the inner circumference face of the flange part (56).

11 Claims, 10 Drawing Sheets

(56) References Cited

U.S. PATENT DOCUMENTS

| | | | | |
|---|---|---|---|---|
| 2002/0110394 | A1 | 8/2002 | Takeuchi et al. | |
| 2004/0120740 | A1* | 6/2004 | Uekawa | G03G 15/2053 399/329 |
| 2015/0177658 | A1* | 6/2015 | Kasama | G03G 15/2053 399/329 |

FOREIGN PATENT DOCUMENTS

| | | | |
|---|---|---|---|
| JP | 2003-316181 | A | 11/2003 |
| JP | 2005-215390 | A | 8/2005 |
| JP | 2005-249958 | A | 9/2005 |
| JP | 2008-139775 | A | 6/2008 |
| JP | 2010-249917 | A | 11/2010 |

* cited by examiner

FIXING DEVICE AND IMAGE FORMING APPARATUS

TECHNICAL FIELD

The present invention relates to a fixing device configured to fix a toner image onto a sheet (recording medium) and an image forming apparatus including the fixing device.

BACKGROUND ART

Conventionally, an electrographic image forming apparatus, such as a copying machine or a printer or the like, includes a fixing device configured to fix a toner image onto a sheet (recording medium).

For example, Patent Document 1 discloses a fixing device including a fixing belt (refer to "fixing film 20" of Patent Document 1), a cap member (refer to "driven ring 34" of Patent Document 1) configured to be attached to an end part of the fixing belt and an elastic member (refer to "elastic member 33" of Patent Document 1) configured to be arranged between the fixing belt and the cap member.

[Patent Document 1] Japanese Unexamined Patent Application, Publication No. Hei10-48977

SUMMARY OF INVENTION

Technical Problem

In the fixing device of Patent Document 1, when a lubricant is applied to an inner circumference face of the fixing belt, there is a possibility that the lubricant goes around an outer circumference face of the fixing belt and gets into between the cap member and the elastic member. When such a situation happens, there is a concern that a slip happens between the cap member and the elastic member.

Taking the above-mentioned situation into consideration, an object of the present invention is to prevent the lubricant from getting into between the cap member and the elastic member and to prevent a slip from happening between the cap member and the elastic member.

Solution to Problem

A fixing device according to the present invention includes a fixing belt configured to rotate around a rotation axis, a pressuring member configured to come into pressure contact with the fixing belt so as to form a fixing nip, a cap member configured to be attached to an end part of the fixing belt and an elastic member configured to be arranged between the fixing belt and the cap member. The cap member includes a main body part configured to cover an outside in the rotation axis direction of the end part of the fixing belt and a flange part configured to extend from the main body part to an inside in the rotation axis direction and to cover an outer diameter side of the end part of the fixing belt. A step is formed in an inner circumference face of the flange part. An outer circumference face of the elastic member comes into contact with an inside part in the rotation axis direction from the step in the inner circumference face of the flange part.

An image forming apparatus according to the present invention includes the above-mentioned fixing device.

Advantageous Effects of Invention

The present invention makes it possible to prevent the lubricant from getting into between the cap member and the elastic member and to prevent a slip from happening between the cap member and the elastic member.

DESCRIPTION OF EMBODIMENTS

Figure 1:
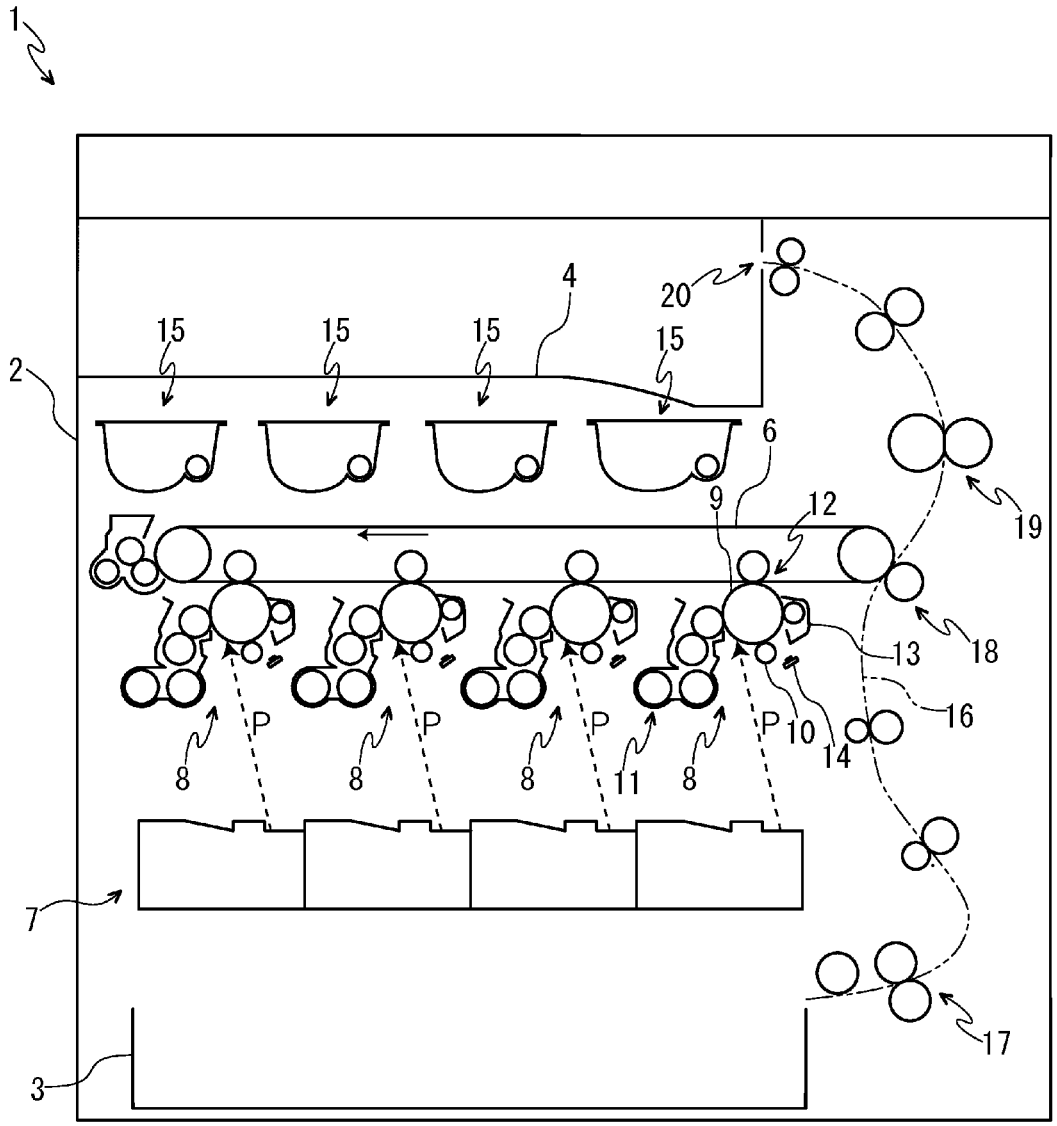
FIG. 1 is a schematic diagram showing an outline of a configuration of a color printer according to an embodiment of the present invention.

First, with reference to FIG. 1, the entire structure of a color printer 1 (an image forming apparatus) will be described. The color printer 1 includes a box-shaped printer main body 2. In a lower part of the printer main body 2, a sheet feeding cartridge 3 storing sheets (not shown) is provided and, on an upper part of the printer main body 2, a sheet ejecting tray 4 is provided.

In a middle part of the printer main body 2, an intermediate transferring belt 6 is bridged over a plurality of rollers and, below the intermediate transferring belt 6, an exposure device 7 consisting of a laser scanning unit (LSU) is arranged. Near the intermediate transferring belt 6, four image forming units 8 are provided for respective colors (for example, four colors of magenta, cyan, yellow and black) of toners along a lower part of the intermediate transferring belt 6. In each image forming unit 8, a photosensitive drum 9 is rotatably provided. Around the photosensitive drum 9, a charger 10, a development device 11, a first transferring unit 12, a cleaning device 13 and a static eliminator 14 are arranged in order of a first transferring process. Above the development device 11, four toner containers 15 corresponding to each image forming units 8 are provided for different colors of toners.

On one side (the right side in the figure) in the printer main body 2, a sheet conveying path 16 is provided. At an upper stream end of the conveying path 16, a sheet feeder 17 is provided. At an intermediate stream part of the conveying path 16, a second transferring unit 18 is provided at one end (the right end in the figure) of the intermediate transferring belt 6. At a lower stream part of the conveying path 16, a fixing device 19 is provided. At a lower stream end of the conveying path 16, a sheet ejecting port 20 is provided.

Next, the operation of forming an image by the color printer 1 having such a configuration will be described. When the power is supplied to the color printer 1, various parameters are initialized and initial determination, such as temperature determination of the fixing device 19, is carried out. Subsequently, when image data is inputted and a printing start is directed from a computer or the like connected with the color printer 1, the image forming operation is carried out as follows.

First, the surface of the photosensitive drum 9 is electrically charged by the charger 10. Then, the surface of the photosensitive drum 9 is irradiated with a laser (refer to an arrow P) by the exposure device 7, thereby forming an electrostatic latent image on the surface of the photosensitive drum 9. The electrostatic latent image is then developed to a toner image having a correspondent color by the developing device 11 with a toner supplied from the toner container 15. The toner image is first-transferred onto the surface of the intermediate transferring belt 6 in the first transferring unit 12. The above-mentioned operation is repeated in order by the image forming units 8, thereby forming the toner image having full color on the intermediate transferring belt 6. Toner and electric charge remained on the photosensitive drum 9 are eliminated by the cleaning device 13 and static eliminator 14.

On the other hand, a sheet fed from the sheet feeding cartridge 3 or a manual bypass tray (not shown) by the sheet feeder 17 is conveyed to the second transferring unit 18 in a suitable timing for the above-mentioned image forming operation. Then, in the second transferring unit 18, the toner image having full color on the intermediate transferring belt 6 is second-transferred onto the sheet. The sheet with the second-transferred toner image is conveyed to a lower stream side on the conveying path 16 to enter the fixing device 19, and then, the toner image is fixed on the sheet in the fixing device 19. The sheet with the fixed toner image is ejected from the sheet ejecting port 20 on the sheet ejecting tray 4.

Next, the fixing device 19 will be described. Incidentally, an arrow Z of FIG. 2 indicates a sheet conveying direction. An arrow Fr arbitrarily shown to each figure indicates a front side of the fixing device 19. An arrow I arbitrarily shown to each figure indicates an inside in a front and rear direction, and an arrow O arbitrarily shown to each figure indicates an outside in the front and rear direction.

Figure 2:
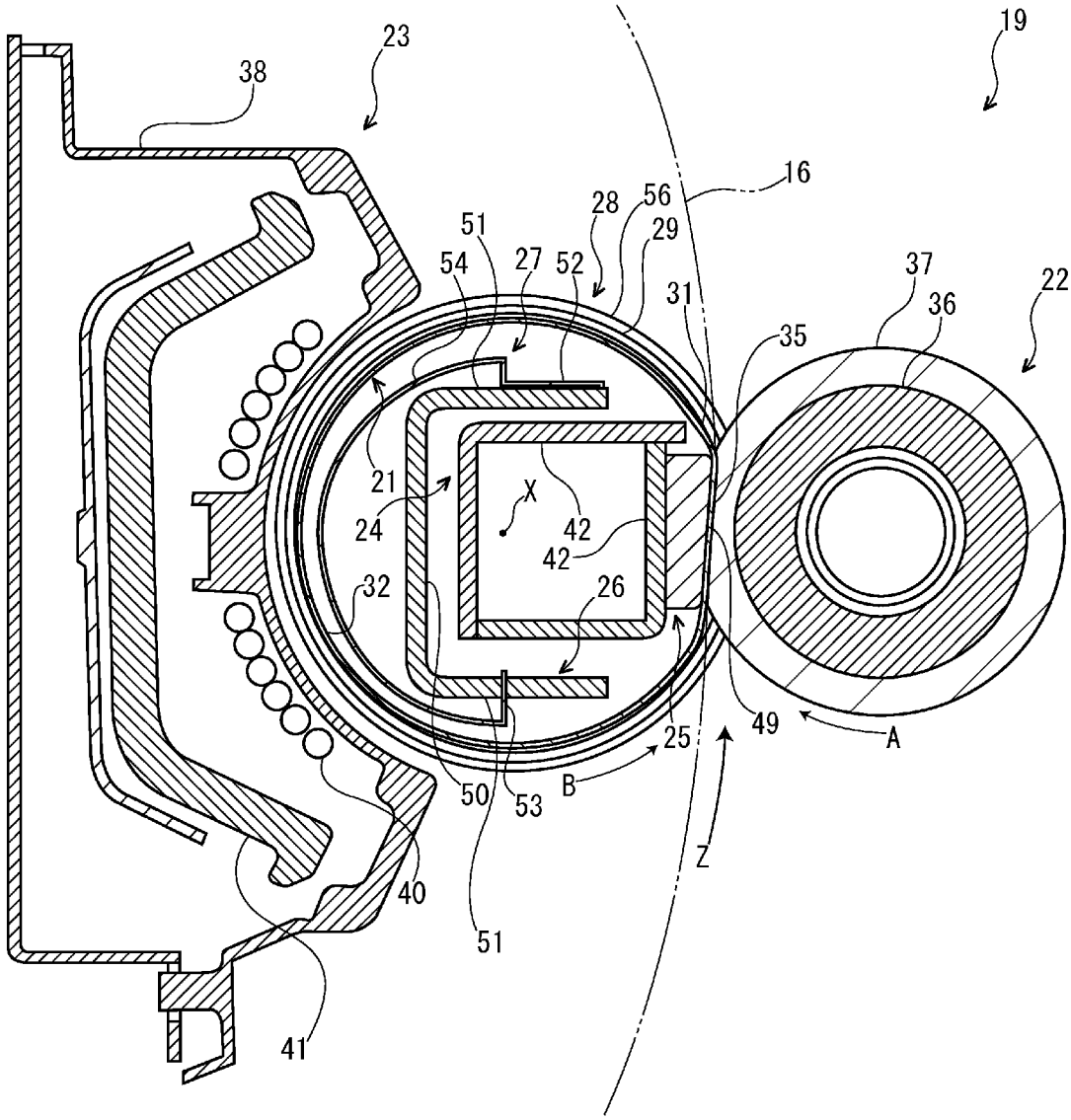
FIG. 2 is a sectional view showing a fixing device according to the embodiment of the present invention.
Figure 3:
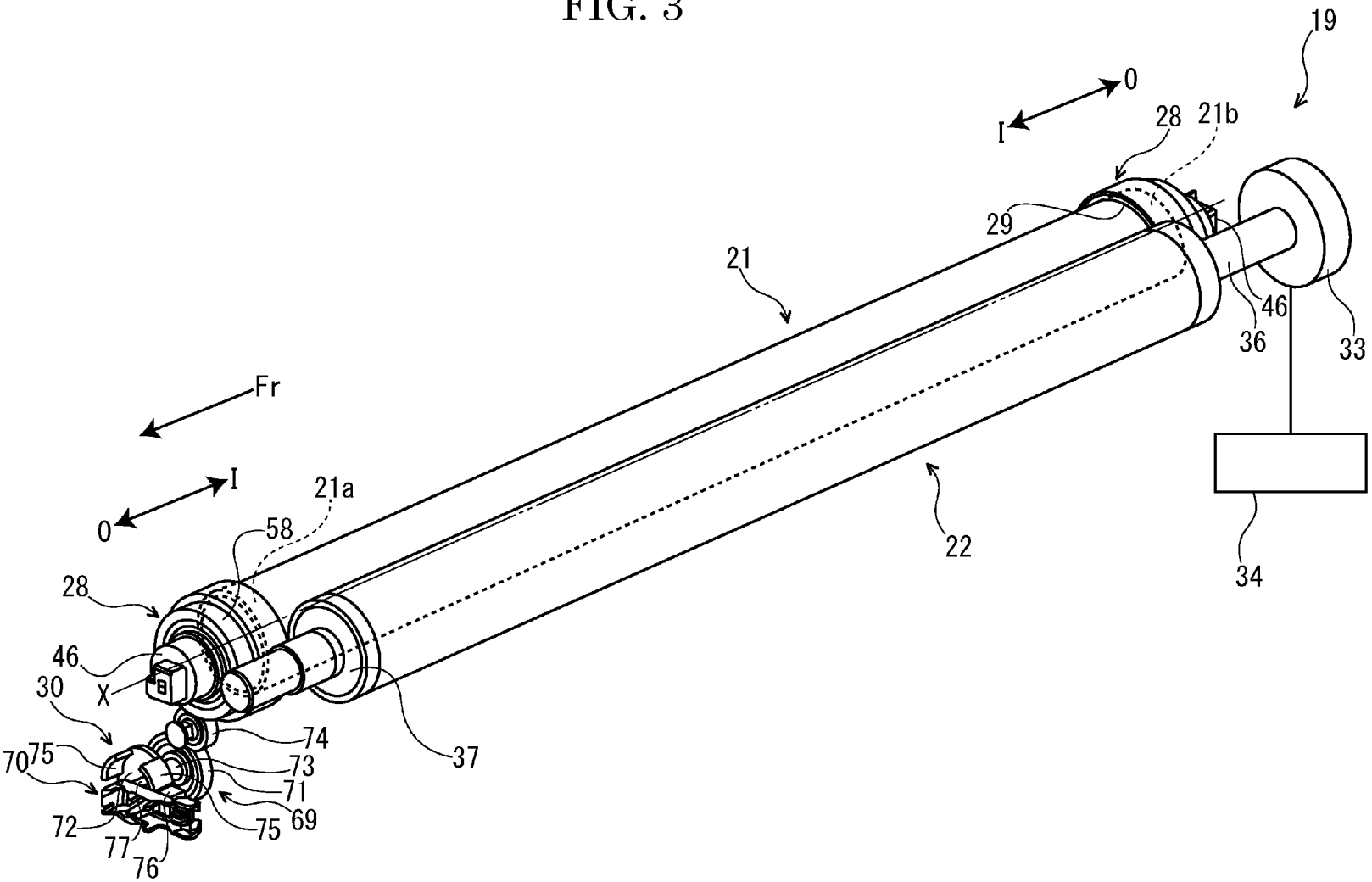
FIG. 3 is a perspective view showing the fixing device according to the embodiment of the present invention.

As shown in FIGS. 2 and 3, the fixing device 19 includes a fixing belt 21, a pressuring roller 22 (a pressuring member) arranged at a right side of the fixing belt 21, an IH fixing unit 23 arranged at a left side of the fixing belt 21, a supporting member 24 arranged at a roughly center of an inside of the fixing belt 21, a pressing pad 25 (pressing member) arranged at a right side of the supporting member 24 at the inside of the fixing belt 21, a magnetic shielding plate 26 arranged at both upper and lower sides and left side of the supporting member 24 at the inside of the fixing belt 21, a guide plate 27 (guide member) arranged at both upper and lower sides and left side of the magnetic shielding plate 26 at the inside of the fixing belt 21, cap members 28 respectively attached to both front and rear end parts 21*a* and 21*b* (a front end part 21*a*, a rear end part 21*b*) of the fixing belt 21, elastic members 29 provided between both front and rear end parts 21*a* and 21*b* of the fixing belt 21 and each cap member 28 and a rotation detecting mechanism 30 arranged at a lower side of the front side cap member 28.

The fixing belt 21 (refer to FIGS. 2 and 3 and other figures) is endless in a circumferential direction and is formed in a roughly cylindrical shape elongated in the front and rear direction. The fixing belt 21 is rotatable around a rotation axis X extending in the front and rear direction. That is, in the present embodiment, the front and rear direction is a rotation axis direction of the fixing belt 21. To an inner circumference face of the fixing belt 21, a lubricant made of, for example, fluorine grease or a silicone oil or the like is applied.

In a right upper part of the fixing belt 21, a bulging part 31 is formed. In a left lower part of the fixing belt 21, one sandwiching part 32 is formed. The one sandwiching part 32 is arranged at an opposite side to the bulging part 31 across the rotation axis X of the fixing belt 21.

The fixing belt 21 is composed of, for example, a base material layer, an elastic layer provided around the base material layer and a release layer covering the elastic layer. The base material layer of the fixing belt 21 is formed by applying plating processing or rolling processing to metal, such as nickel or copper or the like. The elastic layer of the fixing belt 21 is made of, for example, a silicone rubber. The release layer of the fixing belt 21 is made of, for example, fluorine-based resin, such as PFA. In addition, each figure shows the respective layers (the base material layer, the elastic layer and the release layer) of the fixing belt 21 without distinguishing them in particular.

The pressuring roller 22 (refer to FIGS. 2 and 3 and other figures) is formed in a roughly cylindrical shape elongated in the front and rear direction. The pressuring roller 22 comes into pressure contact with the fixing belt 21 so as to form a fixing nip 35 between the fixing belt 21 and the pressuring roller 22 along the conveying path 16 of the sheet. Incidentally, above-mentioned bulging part 31 of the fixing belt 21 is arranged at an upper side (a downstream side in the sheet conveying direction) of the fixing nip 35.

The pressuring roller 22 includes, for example, a cylindrical core material 36, an elastic layer 37 provided around the core material 36 and a release layer (not shown) covering this elastic layer 37.

The core material 36 of the pressuring roller 22 is made of, for example, metal, such as stainless steel or aluminum. Both front and rear end parts of the core material 36 of the pressuring roller 22 is rotatably supported by a fixing frame (not shown). To the rear end part of the core material 36 of the pressuring roller 22, a driving gear 33 is fixed. The driving gear 33 is connected to a driving part 34 composed of a motor or the like.

The elastic layer 37 of the pressuring roller 22 is made of, for example, a silicone rubber or a silicone sponge. The release layer of the pressuring roller 22 is made of, for example, fluorine-based resin, such as PFA.

The IH fixing unit 23 (refer to FIG. 2) includes a case member 38, an IH coil 40 (heat source) which is housed in the case member 38 and is provided in an arc shape along an outer circumference of the fixing belt 21, and an arch core 41 which is housed in the case member 38 and is provided along the outer circumference of the IH coil 40. In addition, the IH fixing unit 23 is not shown except for FIG. 2.

The supporting member 24 (refer to FIG. 2 and other figures) is formed by combining a pair of sheet metal members 42 whose cross sections are L shapes, and is formed in a square cylindrical shape elongated in the front and rear direction. At both front and rear end parts of the supporting member 24, fixing pieces 46 (refer to FIGS. 3 and 4 and other figures) are fixed. A portion at an inside in the front and rear direction of each fixing piece 46 is inserted into the supporting member 24. Each fixing piece 46 is provided with an engagement protrusion 47 at an outside in the front and rear direction of the portion inserted into the supporting member 24. In an outer circumference of the portion at the outside in the front and rear direction of each fixing piece 46, a stopper 48 is fixed. An end part at the outside in the front and rear direction of each fixing piece 46 is fixed to a fixing frame (not shown).

The pressing pad 25 (refer to FIG. 2) is formed in a shape elongated in the front and rear direction. The pressing pad 25 is made of a heat resistant resin, such as an LCP (liquid crystal polymer). The pressing pad 25 is fixed to a right side face of the supporting member 24. Thus, the pressing pad 25 is supported by the supporting member 24.

In a right face of the pressing pad 25, a pressing face 49 is formed. The pressing face 49 presses the fixing belt 21 toward a right side (a side of a pressuring roller 22). The pressing face 49 is inclined to a right side (the side of the pressuring roller 22) toward an upper side (a downstream side in the sheet conveying direction). According to this, the bulging part 31 of the fixing belt 21 arranged at an upper side of the fixing nip 35 (a downstream side in the sheet conveying direction) bulges to an outer diameter side.

The magnetic shielding plate 26 (refer to FIG. 2) is fixed to the supporting member 24. The magnetic shielding plate 26 is made of a non-magnetic material of good conductivity, such as oxygen free copper. The magnetic shielding plate 26 includes a side plate 50 which covers a left side of the supporting member 24, and both upper and lower plates 51 which are bent from both upper and lower end parts of the side plate 50 to the right side, and is formed in a shape whose cross section is a nearly U shape. The magnetic shielding plate 26 prevents a magnetism from the IH coil 40 from penetrating through the supporting member 24.

The guide plate 27 (refer to FIG. 2) is fixed to the magnetic shielding plate 26. The guide plate 27 is formed by a magnetic body, for example. The guide plate 27 includes an upper attachment part 52 which is attached to the upper plate 51 of the magnetic shielding plate 26, a lower attachment part 53 which is attached to the lower plate 51 of the magnetic shielding plate 26, and a curved part 54 which connects the upper attachment part 52 and the lower attachment part 53, and is curved in an arc shape toward the left side. The curved part 54 is arranged along a left side part of an inner circumference face of the fixing belt 21, and guides the fixing belt 21 from the inside.

Figure 5:
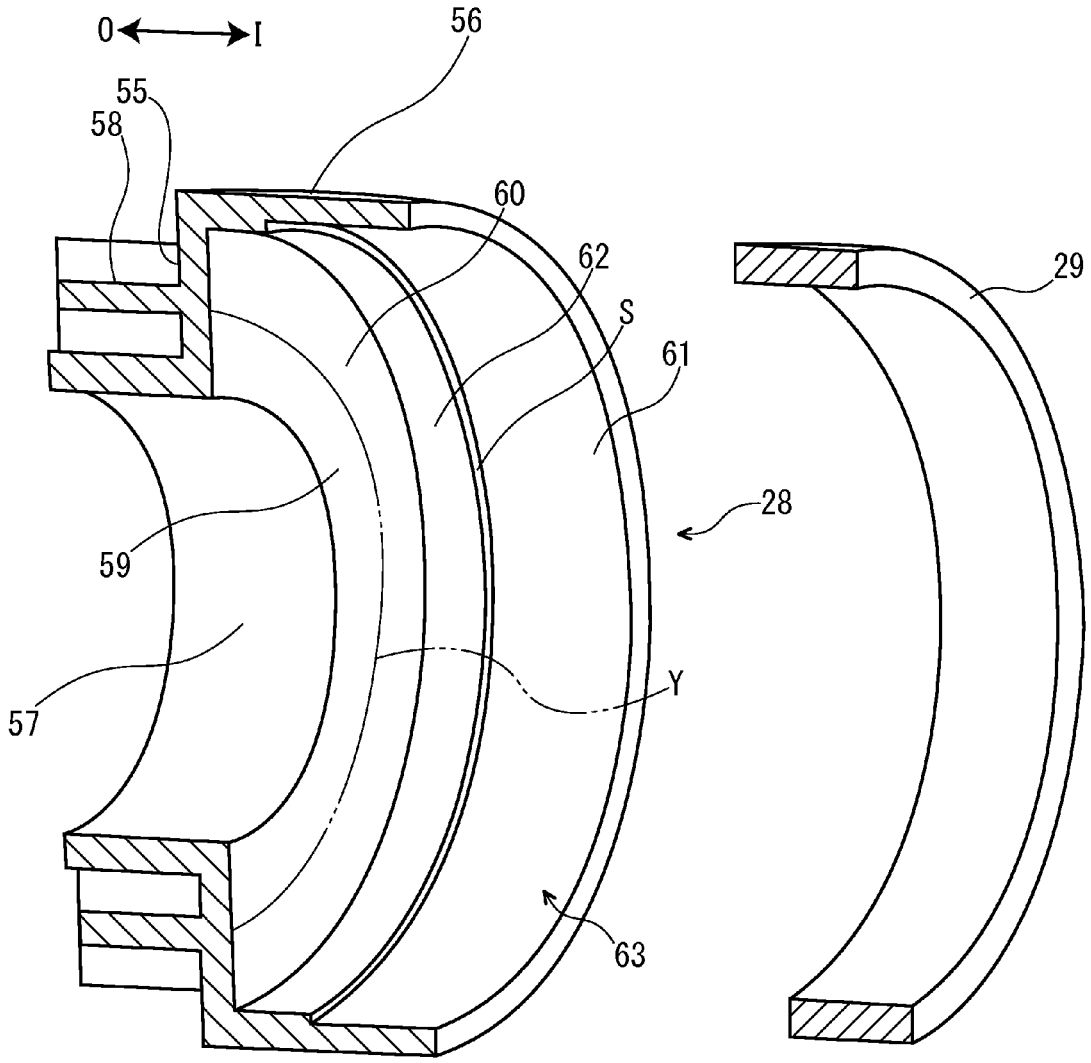
FIG. 5 is a perspective sectional view showing a cap member and an elastic member in the fixing device according to the embodiment of the present invention.
Figure 6:
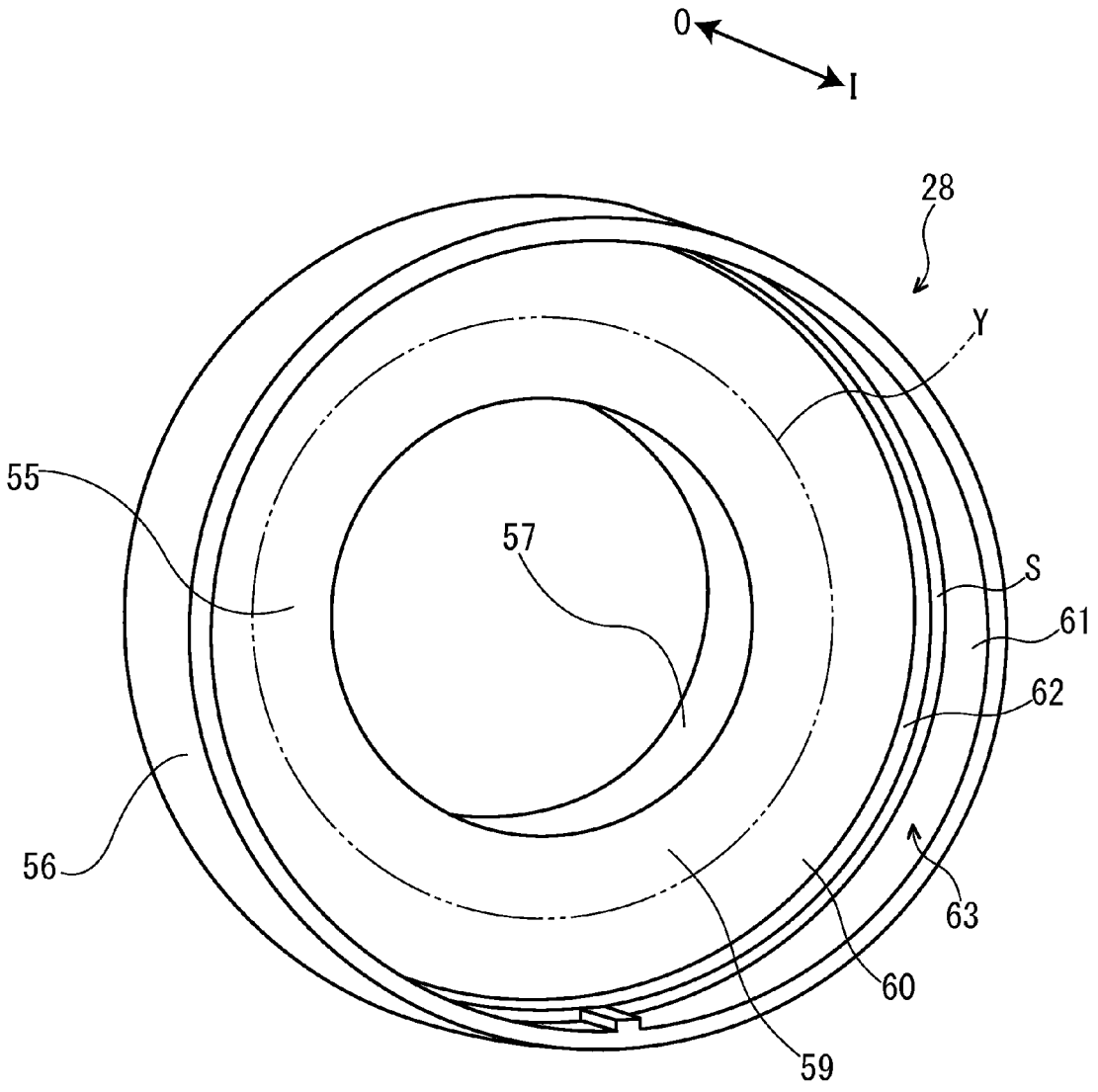
FIG. 6 is a perspective view showing the cap member in the fixing device according to the embodiment of the present invention.

Each cap member 28 (refer to FIGS. 4 to 6 and other figures) includes an annular main body part 55, a flange part 56 which extends from an end part at an outer diameter side of the main body part 55 to the inside in the front and rear direction, an insertion cylindrical part 57 which extends from the end part at the inner diameter side of the main body part 55 to the outside in the front and rear direction and a gear part 58 which projects from a center part in a radial direction of the main body part 55 to the outside in the front and rear direction.

The main body part 55 of each cap member 28 covers outsides in the front and rear direction of the both front and rear end parts 21*a* and 21*b* of the fixing belt 21. Thus, the fixing belt 21 is prevented from meandering (moving to the outside in the front and rear direction of the fixing belt 21). In a face at the inside in the front and rear direction of the main body part 55, an annular non-contact part 59 is formed. The non-contact part 59 is a part which does not come into contact with the both front and rear end parts 21*a* and 21*b* of the fixing belt 21 even when the fixing belt 21 meanders. In the face at the inside in the front and rear direction of the main body part 55, an annular contactable part 60 is formed at the outer diameter side of the non-contact part 59. The contactable part 60 is a part with a possibility to come into contact with the both front and rear end parts 21*a* and 21*b* of the fixing belt 21 when the fixing belt 21 meanders. In addition, a two-dot chain line Y arbitrarily shown to each figure indicates a boundary between the non-contact part 59 and the contactable part 60.

The flange part 56 of each cap member 28 covers outer diameter sides of the both front and rear end parts 21*a*, 21*b* of the fixing belt 21. In an inner circumference face 63 of the flange part 56, a step S is formed. Hereinafter, a part of the inner circumference face 63 of the flange part 56 closer to the inside in the front and rear direction than the step S will be referred to as an "inside part 61", and a part of the inner circumference face 63 of the flange part 56 closer to the outside in the front and rear direction than the step S will be referred to as an "outside part 62". The step S is formed so that the inside part 61 is arranged at an outer diameter side from the outside part 62. The inside part 61 has a larger inner diameter than the outside part 62 and has a longer length in the front and rear direction than the outside part 62.

Figure 7:
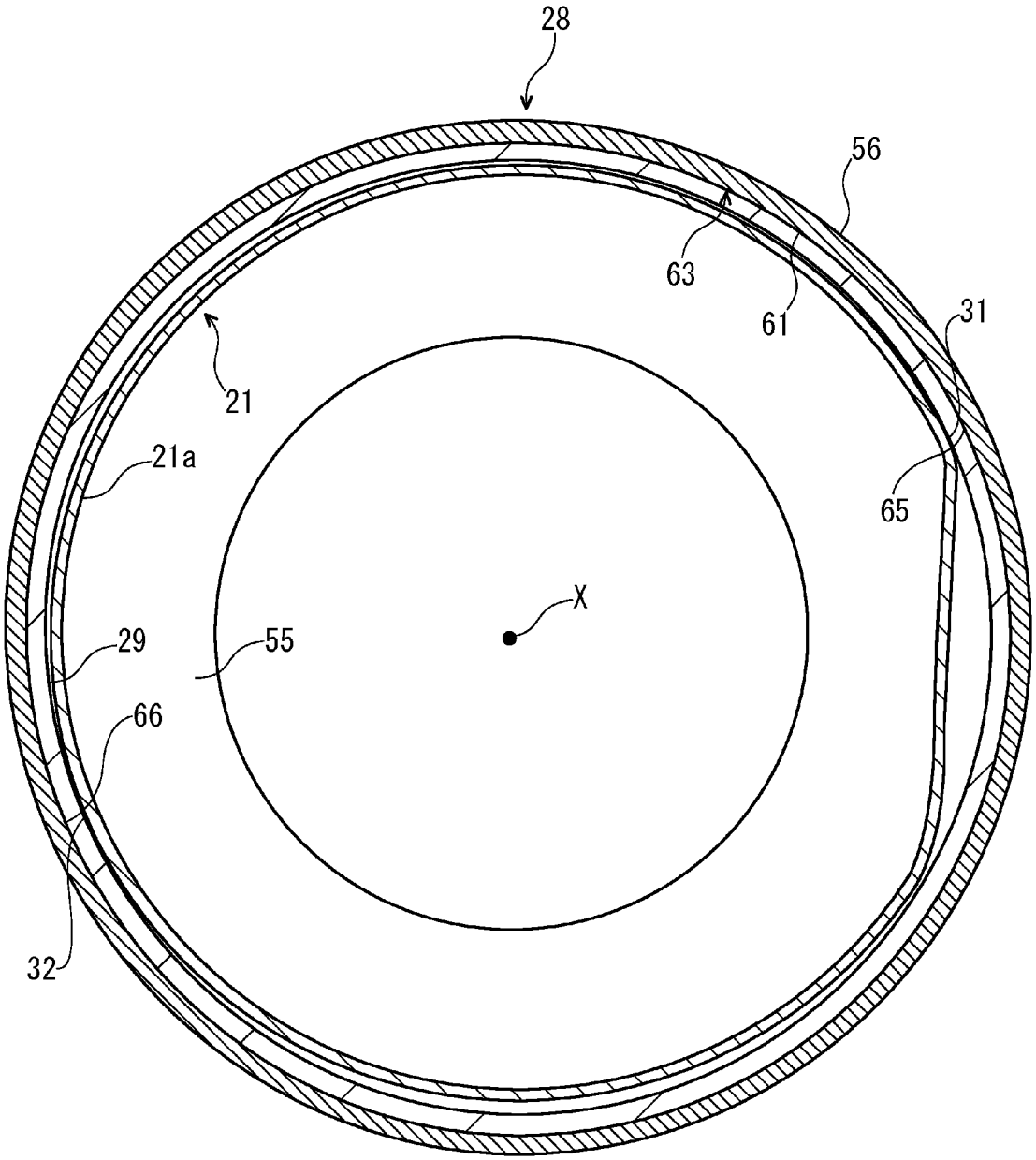
FIG. 7 is a sectional view showing a fixing belt, the cap member and the elastic member in the fixing device according to the embodiment of the present invention.

As shown in FIG. 7 and other figures, at an right upper part of the inside part 61 of the inner circumference face 63 of the flange part 56, a facing part 65 is provided. The facing part 65 faces the bulging part 31 of the fixing belt 21, and sandwiches each elastic member 29 with the bulging part 31 of the fixing belt 21. At a lower left part of the inside part 61 of the inner circumference face 63 of the flange part 56, another sandwiching part 66 is provided. The other sandwiching part 66 is arranged at an opposite side to the facing part 65 across the rotation axis X of the fixing belt 21. The other sandwiching part 66 faces one sandwiching part 32 of the fixing belt 21, and sandwiches each elastic member 29 with the one sandwiching part 32 of the fixing belt 21. According to the above configuration, each cap member 28 is held by the fixing belt 21 via each elastic member 29.

Figure 4:
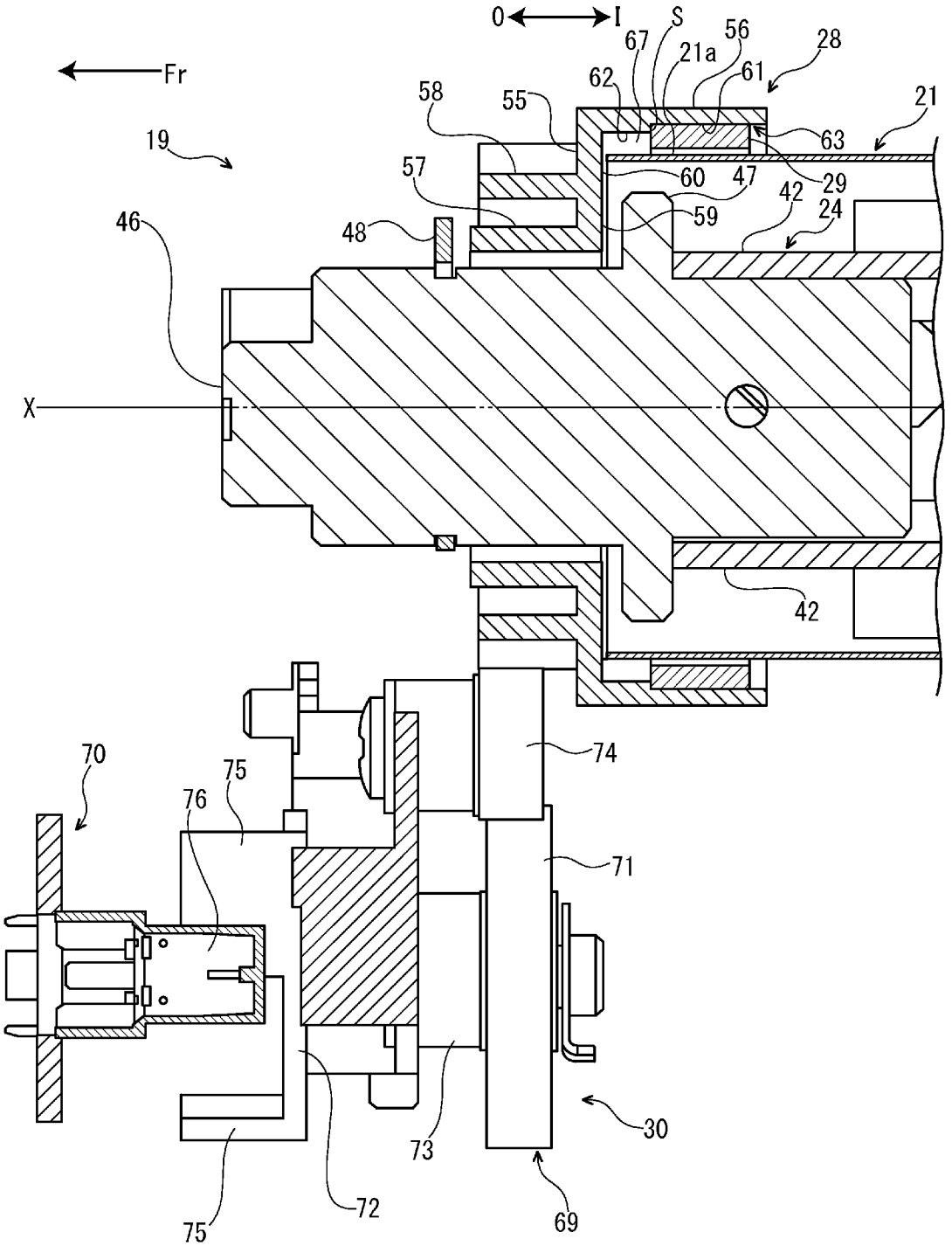
FIG. 4 is a sectional view showing a front end part of the fixing device according to the embodiment of the present invention.

As show in FIG. 4 and other figures, into the insertion cylindrical part 57 of each cap member 28, each fixing piece 46 is loosely inserted. The insertion cylindrical part 57 is arranged at the inside in the front and rear direction of the stopper 48 fixed to each fixing piece 46. Thus, movement of each cap member 28 to the outside in the front and rear direction is regulated.

Each elastic member 29 (refer to FIGS. 4 and 5 and other figures) is formed in a cylindrical shape. Each elastic member 29 is made of a material having liquid absorbency (a silicon sponge which is a foamed material in the present embodiment). An outer circumference face of each elastic member 29 comes into contact with the inside part 61 of the inner circumference face 63 of the flange part 56 of each cap member 28. Each elastic member 29 is attached to each cap member 28 along the step S formed in the inner circumference face 63 of the flange part 56 of each cap member 28. Hence, the outer diameter side part of the outside face in the front and rear direction of each elastic member 29 comes into contact with the step S.

In a space surrounded by the face at the inside in the front and rear direction of the main body part 55 of each cap member 28, the outside part 62 of the inner circumference face 63 of the flange part 56 of the cap member 28 and a face at the outside in the front and rear direction of each elastic member 29, a lubricant holding part 67 is formed.

A rotation detecting mechanism 30 (refer to FIGS. 3 and 4) includes a detected member 69 and a detecting part 70 which is arranged at a front side of the detected member 69.

The detected member 69 includes a detecting gear 71, a pulse plate 72 which is arranged at the front side of the detecting gear 71 and a connection axis 73 which connects the detecting gear 71 and the pulse plate 72. The detecting gear 71 is connected with the gear part 58 of the front cap member 28 via an idle gear 74. On the pulse plate 72, three pulse pieces 75 are provided at equal intervals in a circumferential direction. The detecting part 70 is a PI sensor (Photo Interrupter Sensor), for example, and includes a light emitting part 76 and a light receiving part 77.

When a toner image is fixed to a sheet in the fixing device 19 applying the above-mentioned configuration, a high frequency current is applied to the IH coil 40. According to this, the IH coil 40 generates a magnetic field, this magnetic field functions to generate an eddy current in the fixing belt 21 and the fixing belt 21 generates a heat. That is, the IH coil 40 heats the fixing belt 21. Further, the magnetic field generated by the IH coil 40 causes the guide plate 27 to generate a heat, and the guide plate 27 heats the fixing belt 21.

Furthermore, the driving part 34 rotates the driving gear 33 to fix a toner image to a sheet. When the driving gear 33 is rotated in this way, the pressuring roller 22 is rotated integrally with the driving gear 33 (see arrow A in FIG. 2). According to this, the fixing belt 21 which comes into pressure contact with the pressuring roller 22 is rotated accompanying to a rotation of the pressuring roller 22 (see arrow B in FIG. 2). When the fixing belt 21 is rotated in this way, the fixing belt 21 slides with respect to the pressing pad 25. When the sheet passes through the fixing nip 35 in this state, the sheet and the toner image are heated and pressured, and the toner image is fixed to the sheet.

By the way, when the fixing belt 21 is rotated accompanying to the rotation of the pressuring roller 22 as the present embodiment, if a slip happens between the pressuring roller 22 and the fixing belt 21, the fixing belt 21 cannot be rotated and a part of the fixing belt 21 is locally heated by the IH coil 40. Hence, a rotation state of the fixing belt 21 is grasped as follows in the present embodiment.

When the fixing belt 21 is rotated as described above, each cap member 28 and each elastic member 29 are rotated integrally with the fixing belt 21. When each cap member 28 is rotated in this way, the rotation of the front cap member 28 is transmitted to the detected member 69 via the idle gear 74, and the detected member 69 is rotated. When the detected member 69 is rotated in this way, light irradiated from the light emitting part 76 of the detecting part 70 to the light receiving part 77 is intermittently shielded by each pulse piece 75 of the pulse plate 72 of the detected member 69. Accordingly, a received light amount of the light receiving part 77 of the detecting part 70 alternately switches between high and low. Thus, the rotation detecting mechanism 30 detects a rotation of the front cap member 28.

Meanwhile, when the fixing belt 21 stops, each cap member 28 also stops, and the rotation detecting mechanism 30 does not detect the rotation of the front cap member 28.

In the present embodiment, a rotation state of the fixing belt 21 is grasped by detecting the rotation of the front cap member 28. According to this, it is possible to avoid a situation that the IH coil 40 locally heats a part of the fixing belt 21.

Figure 8:
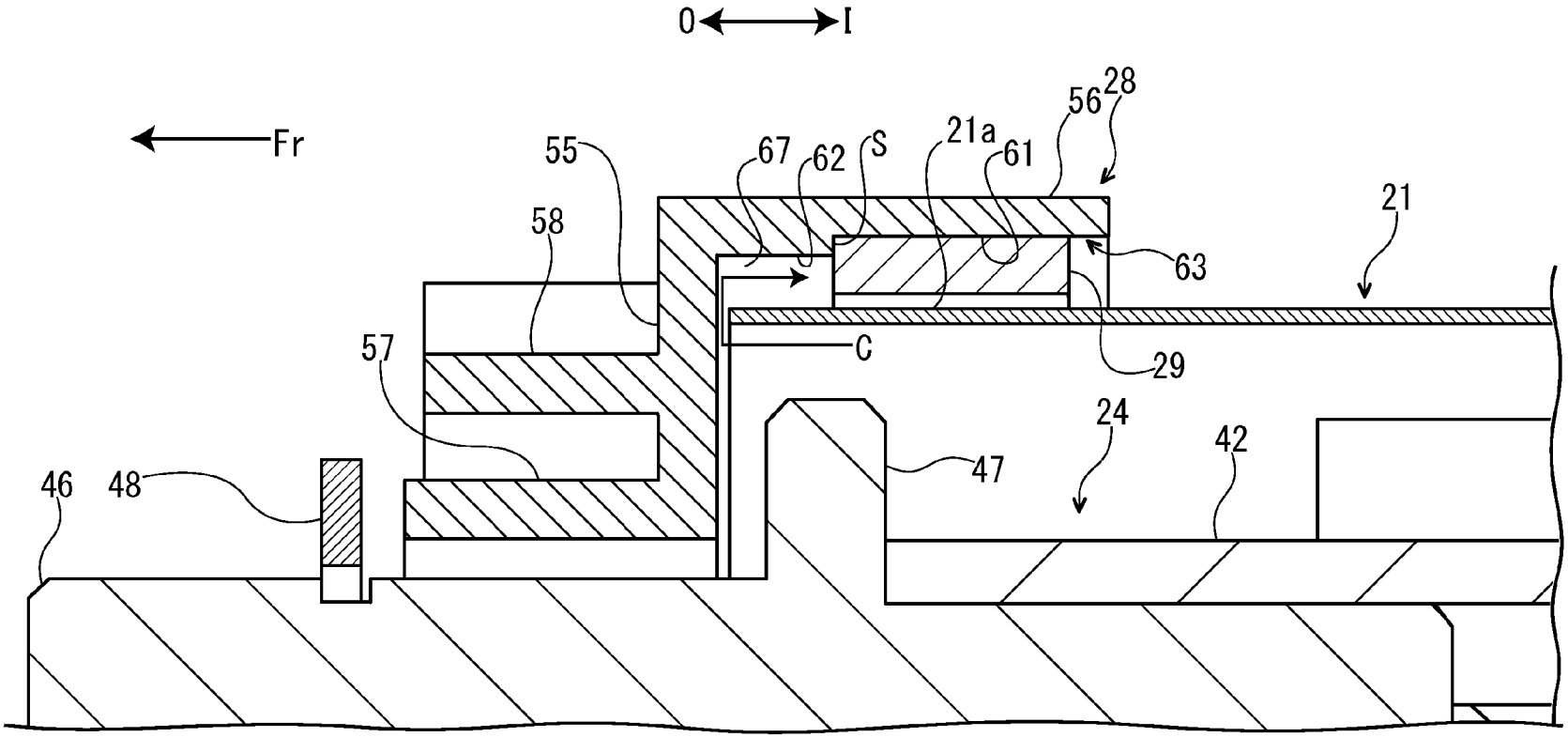
FIG. 8 is a sectional view showing a front end part of the fixing belt and its periphery in the fixing device according to the embodiment of the present invention.

By the way, in the present embodiment, as described above, a lubricant is applied to the inner circumference face of the fixing belt 21. As indicated by arrow C in FIG. 8, this lubricant goes around the outer circumference face of the fixing belt 21 through a gap between the front end part 21*a* of the fixing belt 21 and the main body part 55 of the front gap member 28 in some cases. In such a case, when the lubricant gets into between the inner circumference face 63 of the flange part 56 of the front cap member 28 and an outer circumference face of the front elastic member 29, there is a concern that a slip happens between the front cap member 28 and the front elastic member 29. When the slip happens in this way, the front cap member 28 cannot be rotated integrally with the fixing belt 21, and therefore it becomes difficult to accurately grasp a rotation state of the fixing belt 21

However, in the present embodiment, the step S is formed in the inner circumference face 63 of the flange part 56 of each cap member 28, and the outer circumference face of each elastic member 29 comes into contact with the inside part 61 of the inner circumference face 63 of the flange part 56 of each cap member 28. Hence, even when the lubricant applied to the inner circumference face of the fixing belt 21 goes around the outer circumference face of the fixing belt 21, the lubricant hardly gets into between the inner circumference face 63 of the flange part 56 of the front cap member 28 and the outer circumference face of the front elastic member 29. According to this, it is possible to prevent a slip from happening between the front cap member 28 and the front elastic member 29 and, consequently, accurately grasp the rotation state of the fixing belt 21. Further, the fixing belt 21 can stably hold each cap member 28.

Furthermore, the step S is formed so that the inside part 61 is arranged at the outer diameter side from the outside part 62, and each elastic member 29 is attached to each cap member 28 along the step S. By applying such a configuration, it is possible to use the step S as a reference for attaching each elastic member 29 and, consequently, arrange each elastic member 29 at an adequate position.

Further, in the space surrounded by the face at the inside in the front and rear direction of the main body part 55 of each cap member 28, the outside part 62 of the inner circumference face 63 of the flange part 56 of each cap member 28 and the face at the outside in the front and rear direction of each elastic member 29, the lubricant holding part 67 is formed. By applying such a configuration, when the lubricant applied to the inner circumference face of the fixing belt 21 goes around the outer circumference face of the fixing belt 21, it is possible to cause the lubricant holding part 67 to hold the lubricant. According to this, it is possible to more effectively prevent the lubricant from getting into between the inner circumference face 63 of the flange part 56 of the front cap member 28 and the outer circumference face of the front elastic member 29.

In the present embodiment, each elastic member 29 is made of a material (silicon sponge) having liquid absorbency, and therefore each elastic member 29 can absorb a part of the lubricant held in the lubricant holding part 67. According to this, it is possible to more effectively prevent the lubricant from getting into between the inner circumference face 63 of the flange part 56 of the front cap member 28 and the outer circumference face of the front elastic member 29.

Further, each cap member 28 and each elastic member 29 rotate integrally with the fixing belt 21. By applying such a configuration, it is possible to prevent the fixing belt 21, each cap member 28 and each elastic member 29 from being worn away.

Figure 9:
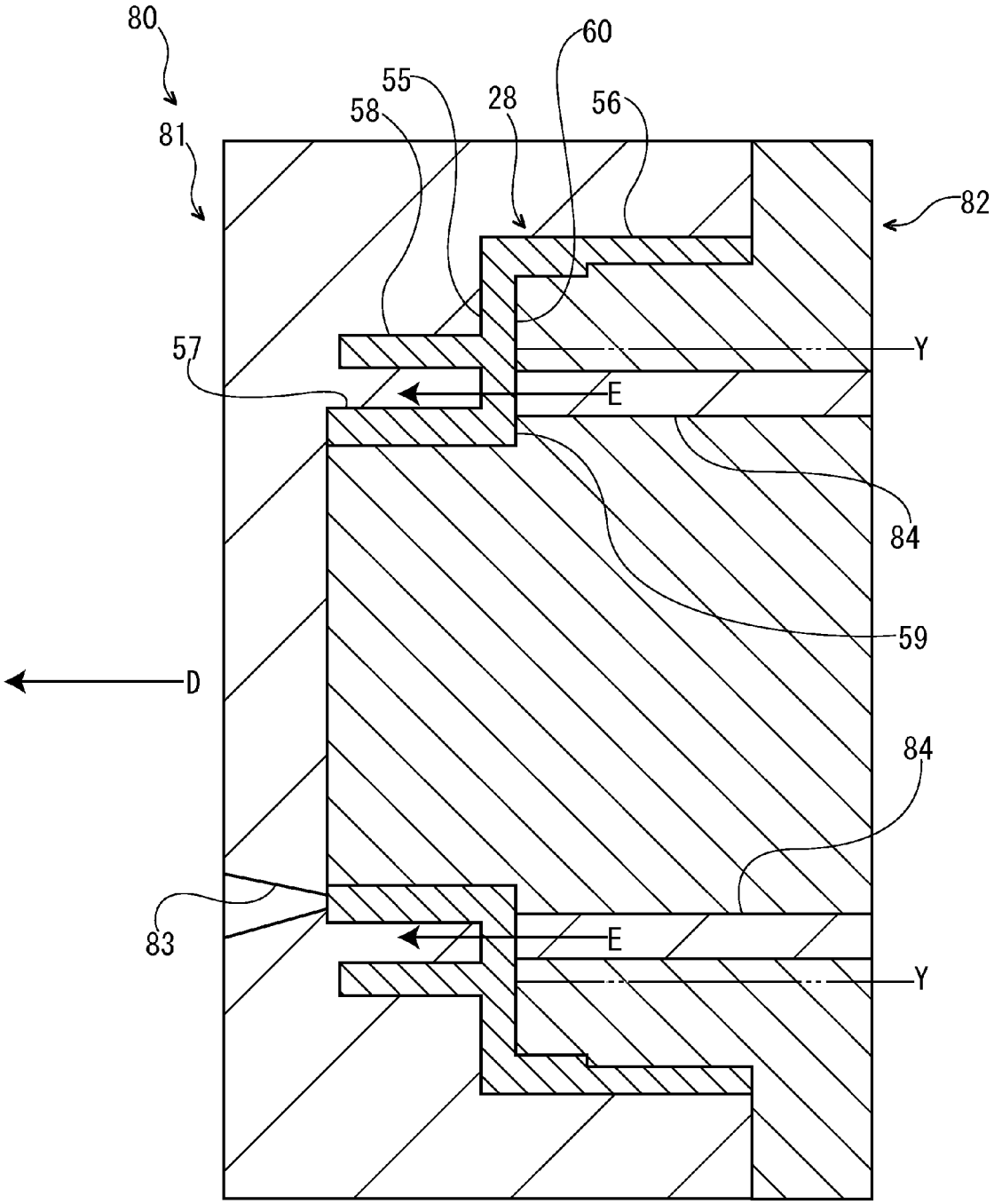
FIG. 9 is a sectional view showing the cap member and a metal mold to manufacture the cap member in the fixing device according to the embodiment of the present invention.

Next, a method of manufacturing the cap members 28 for the fixing device 19 applying the above configuration will be described with reference to FIG. 9.

A metal mold 80 for manufacturing the cap members 28 includes a cavity 81 and a core 82 which is partially inserted into the cavity 81. The cavity 81 is provided with an injection port 83 which allows a resin to be poured between the cavity 81 and the core 82. To the core 82, pin members 84 composed of ejector pins or sleeve pins are attached.

When each cap member 28 is manufactured, a resin is first poured between the cavity 81 and the core 82 through the injection port 83 of the cavity 81 to mold the cap member 28. Next, as indicated by an arrow D in FIG. 9, the cavity 81 is moved in a direction far from the core 82. According to this, the cap member 28 which is a molding article is released from the cavity 81. Next, as indicated by arrows E in FIG. 9, the pin members 84 are projected toward the non-contact part 59 of the main body part 55 of the cap member 28. According to this, the cap member 28 is released from the core 82.

In the present embodiment, as described above, the pin members 84 are projected toward the non-contact part 59 of the main body part 55 of the cap member 28 when the cap member 28 is manufactured, so that cavities and concavities made by a contact with the pin members 84 are formed in the non-contact part 59. Meanwhile, the pin members 84 do not come into contact with the contactable part 60 of the main body part 55 of the cap member 28, and therefore the cavities and concavities are not formed in the contactable part 60. Hence, the contactable part 60 is formed in a flat shape. By applying such a configuration, when the fixing belt 21 meanders (the fixing belt 21 moves to the outside in the front and rear direction), the both front and rear end parts 21*a* and 21*b* of the fixing belt 21 are hardly hooked at the face at the inside in the front and rear direction of the main body part 55 of each cap member 28. According to this, it is possible to prevent the both front and rear end parts 21*a* and 21*b* of the fixing belt 21 from being damaged.

Figure 10:
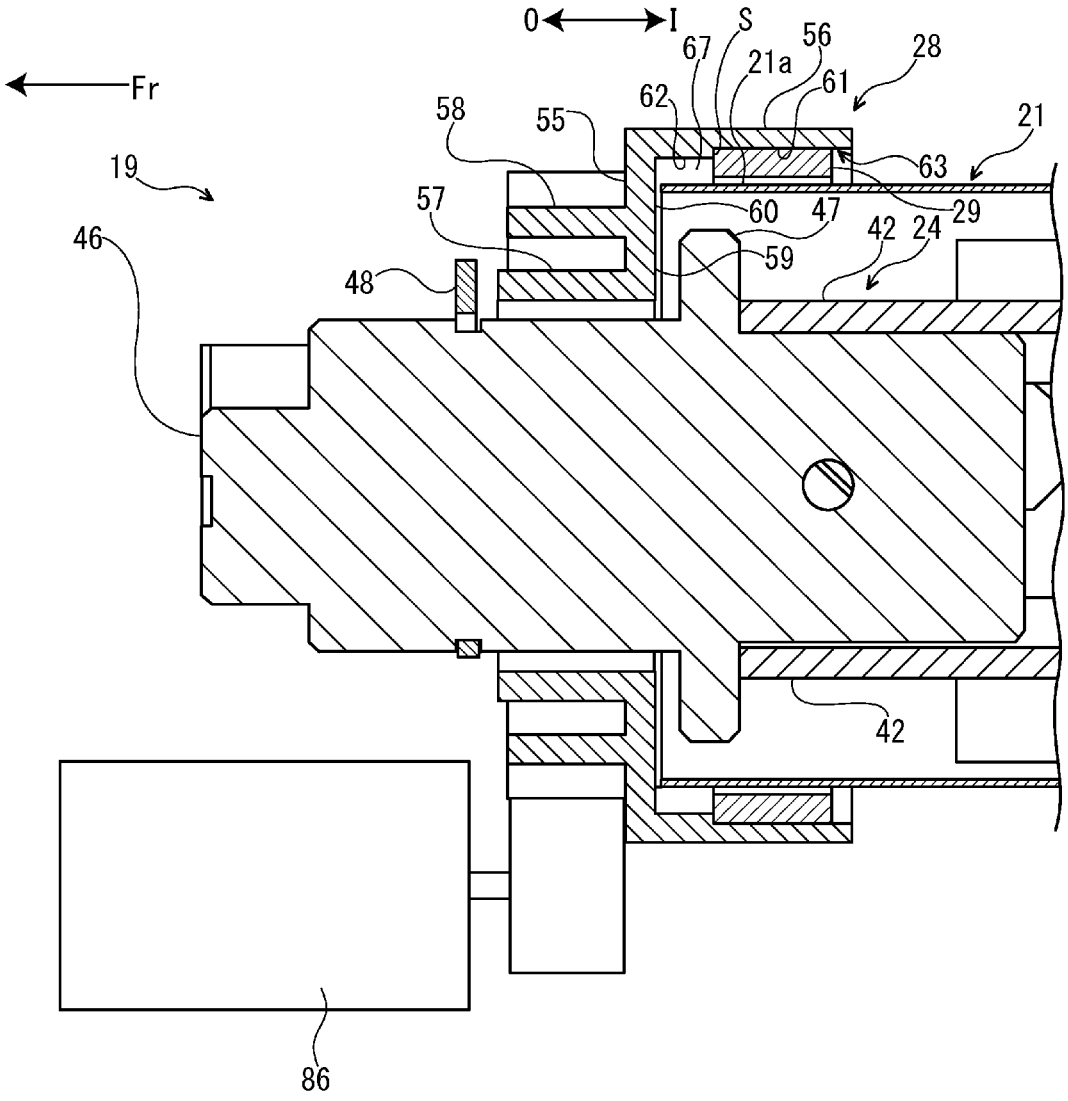
FIG. 10 is a sectional view showing a front end part of a fixing device according to another embodiment of the present invention.

In the present embodiment, a case where the rotation detecting mechanism 30 detects the rotation of the cap member 28 is explained. In another embodiment, as shown in FIG. 10, a drive source 86 composed of a motor or the like may be connected to the cap member 28 and the drive source 86 may rotate the cap member 28. By applying such a configuration, it is possible to apply rotational driving force to the fixing belt 21 from the cap member 28 and to securely rotate the fixing belt 21. Incidentally, above-mentioned drive source 86 may be used alone or used with the driving part 34 which rotates the pressuring roller 22.

In the present embodiment, a case where the step S is formed so that the inside part 61 is arranged at the outer diameter side from the outside part 62 is explained. In another embodiment, the step S may be formed so that the outside part 62 is arranged at the outer diameter side from the inside part 61.

In the present embodiment, a case where each elastic member 29 is made of a silicon sponge is explained. In another embodiment, each elastic member 29 may be made of a material other than the silicon sponge, such as a fluorine-based sponge, a fluorine-based rubber or a urethane resin.

In the present embodiment, a case where the IH coil 40 is used as a heat source is explained. In another embodiment, a heater, such as a halogen heater or a ceramic heater, may be used as a heat source.

In the present embodiment, a case where the configuration of the present invention is applied to a fixing device 19 with a manner that the fixing belt 21 slides with respect to the pressing pad 25 is explained. In another embodiment, the configuration of the present invention may be applied to a fixing device with a manner that the fixing belt 21 is provided around one or more rollers.

In the present embodiment, a case where the configuration of the present invention is applied to a color printer 1 is explained. In another embodiment, the configuration of the present invention may be applied to another image forming apparatus, such as a monochrome printer, a copying machine, a facsimile or a multifunction peripheral.

The invention claimed is:

1. A fixing device comprising:

a fixing belt configured to rotate around a rotation axis;

a pressuring member configured to come into pressure contact with the fixing belt so as to form a fixing nip;

a cap member configured to be attached to an end part of the fixing belt; and an elastic member configured to be arranged between the fixing belt and the cap member, wherein the cap member includes:

a main body part configured to cover an outside in the rotation axis direction of the end part of the fixing belt; and a flange part configured to extend from the main body part to an inside in the rotation axis direction and to cover an outer diameter side of the end part of the fixing belt, and a step is formed in an inner circumference face of the flange part, and an outer circumference face of the elastic member comes into contact with an inside part in the rotation axis direction from the step in the inner circumference face of the flange part, wherein the cap member and the elastic member are rotated integrally with the fixing belt.

2. The fixing device according to claim 1, wherein the step is formed so that the inside part in the rotation axis direction from the step in the inner circumference face of the flange part is arranged at an outer diameter side from an outside part in the rotation axis direction from the step in the inner circumference face of the flange part, and the elastic member is attached to the cap member along the step.

3. The fixing device according to claim 1, wherein a lubricant holding part is formed in a space surrounded by an inside face in the rotation axis direction of the main body part, an outside part in the rotation axis direction from the step in the inner circumference face of the flange part and an outside face in the rotation axis direction of the elastic member.

4. The fixing device according to claim 1, wherein the elastic member is made of a material having liquid absorbency.

5. The fixing device according to claim 1, wherein an inside face in the rotation axis direction of the main body part has a portion with a possibility to come into contact with the end part of the fixing belt and the portion is formed in a flat shape.

6. The fixing device according to claim 1, further comprising a rotation detecting mechanism configured to detect a rotation of the cap member.

7. The fixing device according to claim 1, further comprising a drive source configured to rotate the cap member.

8. The fixing device according to claim 1, further comprising:

a pressing member configured to press the fixing belt to a side of the pressuring member; and a supporting member configured to support the pressing member.

9. The fixing device according to claim 1, further comprising a heat source arranged along an outer circumference of the fixing belt and configured to heat the fixing belt.

10. The fixing device according to claim 1, further comprising a guide member arranged along an inner circumference face of the fixing belt and configured to guide the fixing belt from an inside.

11. An image forming apparatus comprising the fixing device according to claim 1.

* * * * *